US005931166A

United States Patent [19]

Weber et al.

[11] Patent Number: 5,931,166

[45] Date of Patent: Aug. 3, 1999

[54] FINGERNAIL DECORATING

[76] Inventors: Paul J. Weber, 1 Seneca Rd., Ft. Lauderdale, Fla. 33308; Michael R. Weber, 13906 Tern La., Clearwater, Fla. 33762; Luiz B. Da Silva, 1995 Camino Ramon Pl., Danville, Calif. 94526

[21] Appl. No.: 09/218,579

[22] Filed: Dec. 22, 1998

[51] Int. Cl.[6] ..... A45D 29/00

[52] U.S. Cl. ..... 132/73; 132/200; 132/285

[58] Field of Search ..... 132/73, 200, 285, 132/73.6, 75.3, 75.4, 73.5; 606/116, 2, 9, 10, 11; 128/898, 395, 398; 347/70, 71, 94, 68, 40

[56] References Cited

U.S. PATENT DOCUMENTS 4,521,788 6/1985 Kimura et al. ..... 347/68

5,541,630 7/1996 Ema et al. ..... 347/70

5,782,249 7/1998 Weber et al. ..... 132/200

*Primary Examiner*—Gene Mancene

*Assistant Examiner*—Pedro Philogene

*Attorney, Agent, or Firm*—John Lezdey & Assoc.

[57] ABSTRACT

The invention provides a method and an apparatus for decorating or coloring fingernails or toenails. According to the method, a subject's fingernail is scanned to obtain an image and the image is transferred to a computer. The computer then maps out the fingernail surface and scales a selected image or design to fit on the fingernail. This information is then used by the computer to activate an inkjet assembly to print out the stored image on the fingernail surface.

19 Claims, 2 Drawing Sheets

FINGERNAIL DECORATING

BACKGROUND OF THE INVENTION

1. Field of the Invention

The present invention is directed to decorating fingernails by inkjet printing or sputtering. More particularly, there is provided a process and apparatus utilizing inkjet printing and sputtering technology to create an aesthetic appearance to nails.

Fingernails have been decorated to provide an aesthetic appearance or to provide a message. In the past, fingernails were tattooed or lasered to provide a decoration.

Tattooing is usually performed with a press-on decal or manually painting. Lasering usually requires the use of skilled people.

There presently exists a need to provide a technology which can satisfy the fashion needs of the population without fear of injury and can be rapidly and accurately performed.

Inkjets use thermal or piezoelectric technology. In thermally driven inkjets, heat is used to drive ink onto a substrate. There are three main stages with this method. The squirt is initiated by heating the ink to create a bubble until the pressure forces it to burst and hit the paper to form a dot. The bubble then collapses as the element cools, and the resulting vacuum draws ink from the reservoir to replace the ink that was ejected.

Thermal inkjets have print heads containing between 300 and 600 nozzles in total, each about the diameter of a human hair (approx. 70 microns). Tiny heating elements are used to eject ink droplets from the print-head's nozzles. These nozzles deliver drop volumes of around 8–12 picolitres (a picolitre is a million millionth of a liter), and dot sizes of between 50 and 60 microns in diameter. By comparison, the smallest dot size visible to the naked eye is around 30 microns. Dye-based cyan, magenta and yellow (CMY) inks are normally delivered via a combined CMY print-head. Several small color ink drops—typically between four and eight can be combined to deliver a variable dot size, a bigger palette of non-halftoned colors and smoother halftones. Black ink, which is generally based on bigger pigment molecules, is delivered from a separate print-head in larger drop volumes of around 35 pt. Nozzle density, corresponding to the printer's native resolution, varies between 300 and 600 dots per inch (dpi), with enhanced resolutions of 1200 dpi increasingly available. Print speed is chiefly a function of the frequency with which the nozzles can be made to fire ink drops and the width of the swath printed by the print-head. Typically this is around 12 MHz and half an inch respectively, giving print speeds of between 4 to 6 ppm (pages per minute) for monochrome text and 2 to 4 ppm for color text and graphics.

A piezoelectric inkjet uses a piezo crystal at the back of the ink reservoir. This is rather like a loudspeaker cone—it flexes when an electric current flows through it. So, whenever a dot is required, a current is applied to the piezo element, the element flexes and in so doing forces a drop of ink out of the nozzle.

There are several advantages to the piezo method. The process allows more control over the shape and size of ink droplet release. The tiny fluctuations in the crystal allow for smaller droplet sizes and hence higher nozzle density. Also, unlike with thermal technology, the ink does not have to be heated and cooled between each cycle. This saves time, and the ink itself is tailored more for its absorption properties than its ability to withstand high temperatures. This allows more freedom for developing new chemical properties in inks.

Washable tattoos are commercially sold which are applied to both toenails and fingernails. However, such tattoos are not useful or are lost at the beach or swimming pools.

U.S. Pat. No. 5,782,249 to Weber et al, which is herein incorporated by reference, discloses a process for decorating fingernails using laser irradiation.

U.S. Pat. No. 5,541,630 to Yasushi et al, which is herein incorporated by reference, discloses one form of inkjets printing head which can be utilized in the present invention.

U.S. Pat. Nos. 4,521, 788, 4,115, 789, 5,121,132 and 4,158,847, discloses inkjet printing heads and apparatuses which may be used in the present invention.

Therefore, it can be appreciated that there exists a continuing need for a new and improved simple and economical process for decorating fingernails which can be used commercially, as well as, for home use to obtain similar results. In this regard, the present invention substantially fulfills this need.

It is understood that the term "fingernails" also relates to toenails.

SUMMARY OF THE INVENTION

The present invention comprises a method for automatically decorating fingernails with inkjet printing or sputtering. The preferred method involves using an inkjet printer or metal sputtering means which decorates the fingernails with a predetermined display or decoration or colorant. The method provides capturing an image of a subject's fingernail, electronically forming a first fingernail image information representative of the subject's fingernail. The method further provides electronically processing the fingernail's image information to determine the fingernail size and boundary. Optionally, using a stereo imaging or grid projection technique to completely determine the fingernail topography, selecting a design, and then printing out or sputtering on a fingernail said preselected design. Further, in a most preferred embodiment the human hand is secured in a template to immobilize the hand so as to decorate the fingernails more closely and evenly.

More specifically, one preferred embodiment involves a method which comprises the steps of:

a) positioning a hand;

b) taking an image of the fingernail;

c) processing the image to determine the fingernail boundary, optionally using a system of grids or stereo imaging to generate a three dimensional surface of the fingernail; and then d) printing out on the fingernail said preselected decoration.

Advantageously, the method can include electronically forming a composite image of the image from step c) in combination with an appropriately scaled image of a selected design before printing the design.

The selected design can be obtained by scanning a picture and then electronically form the composite or obtaining a design from a stored memory in a computer.

In the decorating procedure, one or more coatings of a colorant may be utilized to provide a colored design. Alternatively, a design can be imparted on the nail and a suitable colorant or overcoat utilized before or after printing the design.

The invention further provides an apparatus for printing and sputtering a design on a fingernail which comprises:

1. a fingernail positioning means;
2. a camera for taking an image of the fingernail;
3. an inkjet printing or sputtering means;
4. a microprocessor for receiving the image, said microprocessor further containing a memory having at least one stored image and a software program for mapping out the fingernail surface optionally using a projection technique or a system of grids to analyze the nail, and then activating means for causing the printing or sputtering means to produce the design on the fingernail. Optionally, the camera is also provided with a means for scanning a picture and transmitting the picture to the microprocessor to become a stored image for producing the design.

It is an object of the invention to provide an apparatus for decorating nails.

It is another object to provide decorations to the fingernails using a camera and digital acquisition electronics to acquire an image of the fingernails and scaling the decorations to fit the fingernail surface.

It is a further object of the invention to provide a method for automatically providing a design on fingernails.

Other objects and many of the attendant advantages of this invention will be readily appreciated as the same become better understood by reference to the following detailed description when considered in conjunction with the accompanying drawings.

DESCRIPTION OF THE PREFERRED EMBODIMENTS

The present invention discloses unique fingernail decorating apparatus 10 that employs a computerized video camera 14 that can map out key characteristics of the fingernail surface and stored images to generate a novel composite that is a hybrid of the fingernail and the stored images. The subject-user 12 has many choices in creating a composite image which acts through a computer in association with an inkjet printer to create a selected design from the stored images on the fingernails.

Figure 1A:
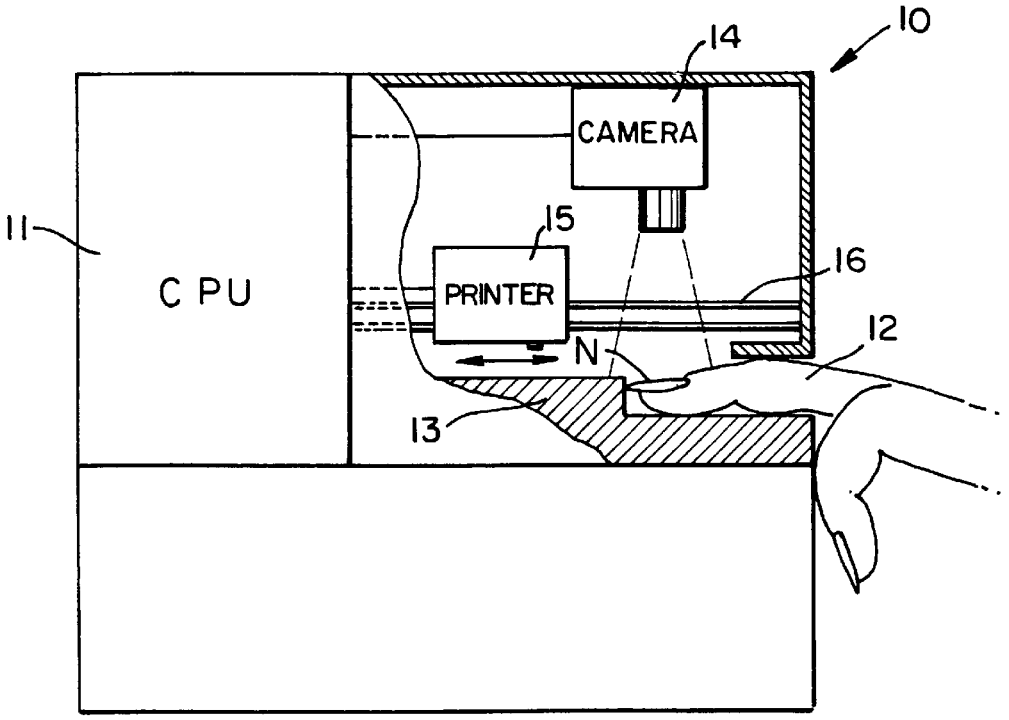
FIGS. 1A and 1B are schematic illustrations of the apparatus and method of the invention.
Figure 1B:
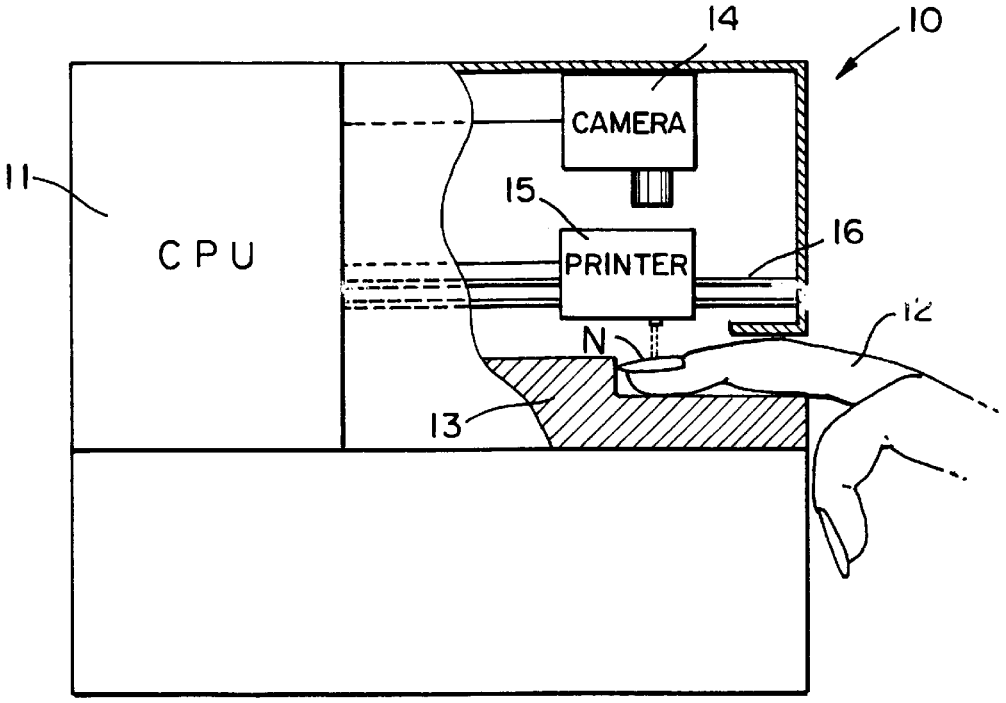

As illustrated in FIGS. 1A and 1B, a subject-user places a finger 12 in a holder 13 of apparatus 10. A camera 14 takes an image of the fingernail N. The computer 11 acquires the image and maps out the fingernail boundary. Optionally, by acquiring additional images, the topography of the fingernail surface can be determined. The computer 11 then uses this map to scale the selected design onto the fingernail surface. A design image is then printed out on the fingernail N according to the map by means of an inkjet printing assembly 15 which travels along holder 16 to generate the image or decoration on the fingernail. The mapping of the fingernail is to account for the depth and size of the fingernail and to accurately center a selected design.

Suitable computer hardware software which can be used is available from Panasonic Corporation of Japan or from National Instruments, Inc. of Austin Tex.

Figure 2:
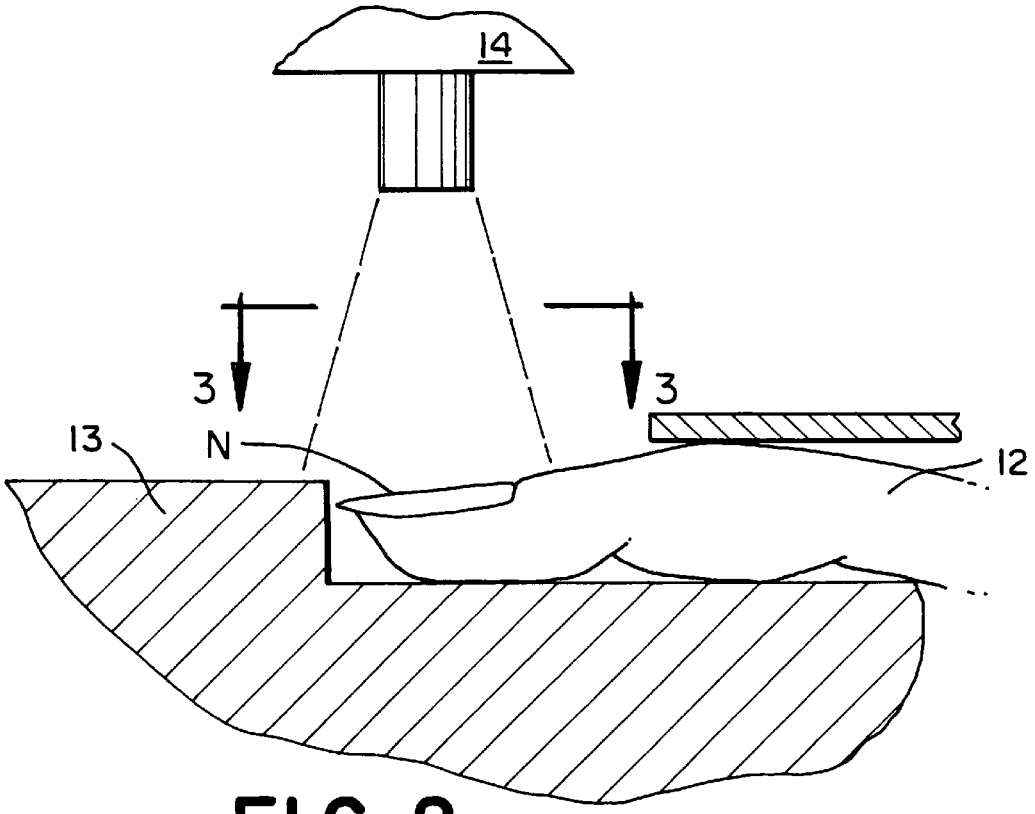
FIG. 2 is a schematic view of the finger holding part of the apparatus during scanning.
Figure 3:
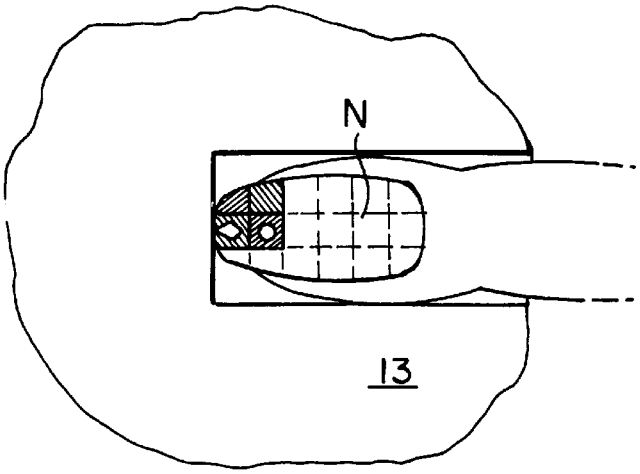
FIG. 3 is a schematic illustration of a grid projection technique which can be used to calculate the dimensional surface of the fingernail.

As seen in FIGS. 2 and 3, the camera 14, which is preferably a video camera, can take a real-time image along line 3—3 of all of the fingernails on the hand of a subject user. A subprogram includes means for detecting the boundary of the fingernail image and calculating the fingernail topography. The selected design is then scaled to fit on a fingernail surface and the color and location of each drop to be applied is calculated. The information is then transmitted to the inkjet printer 15 which prints out the design.

The camera 11 is preferably a video camera and generally includes a camera housing, lens and circuitry means for operating the camera.

Alternatively, the camera 11 can comprise a digital camera.

The camera 11 either alone or in combination with a second camera means can function as a scanner to take an image of a picture for placing into the stored image program for use as a design for the fingernail.

A preferred inkjet assembly is of the type disclosed in U.S. Pat. No. 4,115,789, which is herein incorporated by reference. The assembly comprises a piezoelectric driver and a liquid droplet instrument. The driver includes a plurality of piezoelectric members which may be selectively energized by the computer. The inkjet assembly travels along the holder by the action of a step motor (not shown) and in response to signals from the computer to produce the selected images. The assembly may also comprise piezoelectric or magnetoelectric drivers.

The stored image which forms the final design can comprise numbers, alone or in sequence, letters, flowers, or the like. The image can be placed on enameled nails or plain nails. If desired, the decoration may merely comprise a single color over the entire nail.

The stored image can also comprise an image which is inputted into the microprocessor at the time of activation so as to include a subject image submitted by the user. This can be obtained by scanning a picture.

It can therefore be seen that the invention embodies a method of automatically taking, processing and then printing or sputtering a selected design onto a subject-user's fingernails in response to actuating controls in an apparatus utilized where the user inserts his fingers into a holder for scanning.

It should be understood that the design may be formed with an ink, paint, adhesive, or the like. The design may be formed by one or more layers. If formed with an adhesive, the adhesive may be used to attach additional decorants such as glitter, sequins, diamonds, gold dust, and the like. A preferred adhesive is an epoxy glue.

Although the invention has been described with reference to certain preferred embodiments, it will be appreciated that many variations and modifications may be made within the scope of the broad principles of the invention. For example, this invention can be used as a game or as an informational tool for social or legal matters, legal enforcement or insurance purposes, scientific investigations and the like. Also, the mapping of the fingernail can be performed utilizing lights such as laser lights to provide information on the characteristics of the fingernail. In this regard, simple lamps with a grid can be used to project a grid on the fingernail. Hence, it is intended that the preferred embodiments and all of such variations and modifications be included within the scope and spirit of the invention, as defined by the following claims.

What is claimed is:

1. An apparatus for providing a design and a colorant on a fingernail comprising a finger positioning means, a camera for receiving at least one image of a subject-user's fingernail, an inkjet printing means and a microprocessor for operating photographic functions and for receiving said at least one fingernail image, said microprocessor further containing a memory having at least one stored image and a software program for mapping out the fingernail surface, and then activating said printing means in association with the fingernail surface map to produce a design of a stored image on said fingernail.

2. The apparatus of claim 1 wherein said stored image is selected from the group consisting of flowers, letters and numbers.

3. The apparatus of claim 1 wherein said inkjet printing means comprises an actuator selected from the group consisting of a piezoelectric and magnetoelectric actuator.

4. The apparatus of claim 1 wherein said inkjet printing means contains a piezoelectric driver.

5. The apparatus of claim 1 wherein the topography of the fingernail surface is determined by using an optical technique.

6. The apparatus of claim 1 including means for scanning a picture so as to provide a stored image.

7. The apparatus of claim 1 wherein said inkjet printing means comprises a sputtering devices.

8. A method of taking, processing and delivering a design on a fingernail of a subject in response to providing a photographic image of a subject's fingernail comprising the steps of:

a) electronically forming a first fingernail image information representative of the fingernail of the subject;

b) electronically processing said first image information to form a second electronic image information mapping out said fingernail image;

c) electronically processing said image of step b) in combination with said third image of a design to form a scaled composite; and then d) printing said scaled design image on said fingernail.

9. The method of claim 8 wherein said fingernail is mapped using stereo imaging or grid projection techniques.

10. The method of claim 8 wherein said mapped image is three dimensional.

11. The method of claim 8 wherein said printing in step d) is with an inkjet assembly means.

12. The method of claim 8 wherein design is selected from the group consisting of flowers, letters, numbers and mammals.

13. The method of claim 8 wherein said design is formed by scanning a picture.

14. The method of claim 8 wherein said design is formed with an adhesive.

15. The method of claim 8 wherein said design comprises a colorant.

16. A method of placing a scaled design on a fingernail which comprises the steps of:

a) acquiring an image of a fingernail;

b) determining the boundary of the fingernail to be printed;

c) mapping a desired design on said fingernail image; and d) apply said mapped design to said fingernail by inkjet printing.

17. The method of claim 15 wherein said fingernail is mapped using a method selected from the group consisting of stereo imaging and grid projection.

18. The method of claim 16 wherein said design is selected from the group consisting of flowers, letters, numbers and mammals.

19. The method of claim 16 including the step of providing an overcoat on the fingernail after step d).

* * * * *